US006568796B2

(12) United States Patent
Harajiri

(10) Patent No.: US 6,568,796 B2
(45) Date of Patent: May 27, 2003

(54) HEAD CHIP AND HEAD UNIT HAVING HEAD CHIP

(75) Inventor: Toshihiko Harajiri, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/864,960

(22) Filed: May 24, 2001

(65) Prior Publication Data

US 2002/0003559 A1 Jan. 10, 2002

(30) Foreign Application Priority Data

May 31, 2000 (JP) ..... 2000-163267

(51) Int. Cl.[7] ..... B41J 2/045
(52) U.S. Cl. ..... 347/68
(58) Field of Search ..... 347/68, 71, 72

(56) References Cited

U.S. PATENT DOCUMENTS 5,557,309 A * 9/1996 Hayes ..... 347/71
5,619,235 A * 4/1997 Suzuki ..... 347/69
6,281,914 B1 * 8/2001 Hiwada et al. ..... 347/50

FOREIGN PATENT DOCUMENTS

JP 59209882 11/1984

* cited by examiner

*Primary Examiner*—Thinh Nguyen
(74) *Attorney, Agent, or Firm*—Adams & Wilks

(57) ABSTRACT

A head chip has a substrate having a first main surface and a second main surface opposite the first main surface. First partition walls are disposed on the first main surface of the substrate in spaced apart relation at a preselected interval to form first channels each for receiving ink. Second partition walls are disposed on the second main surface of the substrate in spaced apart relation at a preselected interval to form second channels each for receiving ink. Electrodes are connected to side walls of the first and second channels and are driven by a voltage signal to deform the side walls to vary the volume in the first and second channels to thereby eject ink from the first and second channels.

26 Claims, 16 Drawing Sheets

PRIOR ART

PRIOR ART

HEAD CHIP AND HEAD UNIT HAVING HEAD CHIP

BACKGROUND OF THE INVENTION

1. Field of the Invention

The present invention relates to a head chip that is mounted on an ink-jet type recording apparatus applicable to, for example, a printer and a facsimile, and a head unit using the head chip.

2. Description of the Related Art

Conventionally, an ink-jet type recording apparatus is known in the technical field, in which a recording head for jetting ink droplets from a plurality of nozzles is employed to record characters and/or images on a recording medium. In such an ink-jet type recording apparatus, the recording head positioned opposite to the recording medium is provided on a head holder, and the head holder is mounted on a carriage so as to be scanned along a direction perpendicular to a transport direction of the recording medium.

In FIG. 14, there is shown an exploded/perspective view of one example of such a recording head. FIGS. 15A and 15B are sectional view of a major portion of this recording head. FIG. 15A is a sectional view of the recording head taken along the longitudinal direction of side walls. FIG. 15B is a sectional view of the recording head taken along the thickness direction of side walls. As shown in FIG. 14 and FIG. 15, a plurality of grooves 102 are arranged in a piezoelectric ceramic plate 101 in a parallel manner. The respective grooves 102 are separated from each other by side walls 103. One end portion of each of the grooves 102 in the longitudinal direction is elongated up to one end surface of the piezoelectric ceramic plate 101, whereas the other end portion is not elongated up to the other end surface of this piezoelectric ceramic plate, and a depth thereof gradually becomes shallow. Also, an electrode 105 for applying a driving electric field is formed on surfaces of both the side walls 103 on the opening side within each of the grooves 102 along the longitudinal direction.

A cover plate 107 is jointed via an adhesive agent 109 to the grooves 102 of the piezoelectric ceramic plate 101 on the opening side. This cover plate 107 has an ink chamber 111 that constitutes a concave portion which is communicated to the shallow other end portion of each of the grooves 102 and an ink supply port 112 that is penetrated through a bottom portion of this ink chamber 111 along a direction opposite to the direction of the grooves 102.

A nozzle plate 115 is joined to an end surface of a joint member made by the piezoelectric ceramic plate 101 and the cover plate 107, at which the grooves 102 are opened. Nozzle openings 117 are formed in the nozzle plate 115 at such positions located opposite to the respective grooves 102.

It should be noted that a wiring board 120 is fixed on such a surface of the piezoelectric ceramic plate 101, which is located opposite to the nozzle plate 115 and also opposite to the cover plate 107. A wiring line 122 which is electrically connected to each of the electrodes 105 by employing a bonding wire 121 or the like is formed on the wiring board 120. A driver voltage may be applied via this wiring line 122 to the electrode 105.

In the,recording head constituted as described above, when ink is filled from the ink supply port 112 into the respective grooves 102 and a predetermined driving electric field is applied via the electrode 105 to the side walls 103 on both sides of a predetermined groove 102, the side walls 103 are deformed, so that a capacity formed within this predetermined groove 102 is changed. As a result, the ink filled in the grooves 102 may be jetted from the nozzle opening 117.

For example, as shown in FIG. 16, in the case where ink is jetted from a nozzle opening 117 corresponding to a groove 102*a*, a positive driving voltage is applied to both electrodes 105*a* and 105*b* provided in the groove 102*a*, and also electrodes 105*c* and 105*d* located opposite to these electrodes 105*a* and 105*b* are grounded. As a consequence, a driving electric field directed to the groove 102*a* is effected to the side walls 103*a* and 103*b*. When this driving electric field is positioned perpendicular to the polarization direction of the piezoelectric ceramic plate 101, both the side walls 103*a* and 103*b* are deformed along the direction of the groove 102*a* due to the piezoelectric thickness slip effect, so that the capacity defined in the groove 102*a* is reduced to thereby increase pressure. Thus, the ink may be jetted from the nozzle opening 117.

Further, such a head chip is mounted on an ink jet type recording apparatus, and this has widely spread as a color printer by using color ink. Along with this, it is required that printing quality and recording density are improved.

However, in the case where grooves are arranged with high density for improving the printing quality and the recording density, there is a problem in that the thickness of the side walls between the respective grooves becomes thinner, and thus rigidity of the side walls is insufficient, thereby causing generation of crosstalk between respective chambers.

SUMMARY OF THE INVENTION

The present invention has been made in view of the above, and an object of the present invention is to provide a head chip and a head unit in which recording density is improved and also manufacturing cost is reduced.

In order to solve the above problems, according to a first aspect of the present invention there is a head chip in which: partition walls made of piezoelectric ceramic are arranged on a board with predetermined intervals; chambers are defined between the respective partition walls; a driver voltage is applied to electrodes provided on the side surfaces of the partition walls to change the capacity in the chambers; and the ink filled in the chambers is jetted from nozzle openings, characterized in that the chambers are arranged between upper and lower sheets of boards, which are made of a dielectric material having a light transmitting property, in the width direction with predetermined intervals, and also a plurality of the boards are laminated in the vertical direction.

According to a second aspect of the present invention, in the first aspect of the present invention, there is provided a head chipcharacterized in that a plurality of units, in which the partition walls are arranged between two boards with predetermined intervals, are laminated.

According to a third aspect of the present invention, in the first aspect of the present invention, there is provided a head chip characterized in that the partition walls are arranged on both surfaces of a board with predetermined intervals.

According to a fourth aspect of the present invention, in the first aspect of the present invention, there is provided a head chip, characterized in that:

a nozzle plate having the nozzle openings that communicate with the chambers is provided at end surfaces of the partition walls in the longitudinal direction; and ink chambers that communicate with the respective chambers, are provided on the side of the other end portions of the partition walls.

According to a fifth aspect of the present invention, in the fourth aspect of the present invention, there is provided a head chip characterized in that the nozzle plate is formed of a dielectric material.

According to a sixth aspect of the present invention, there is provided a head unit characterized in that the head unit comprises a head chip as described above and a head holder that mounts the head chip.

According to a seventh aspect of the present invention, in the sixth aspect of the present invention, there is provided a head unit characterized in that the head holder may detachably hold an ink cartridge in which ink is stored.

According to the present invention, alignment of chambers when arranging in parallel the chambers on both surfaces of the board can be easily performed by using the board formed from a transparent dielectric material, and thus recording density can be improved.

DETAILED DESCRIPTION OF THE PREFERED EMBODIMENTS

Hereinafter, the present invention will be explained in detail with reference to embodiments.

Embodiment 1

Figure 1:
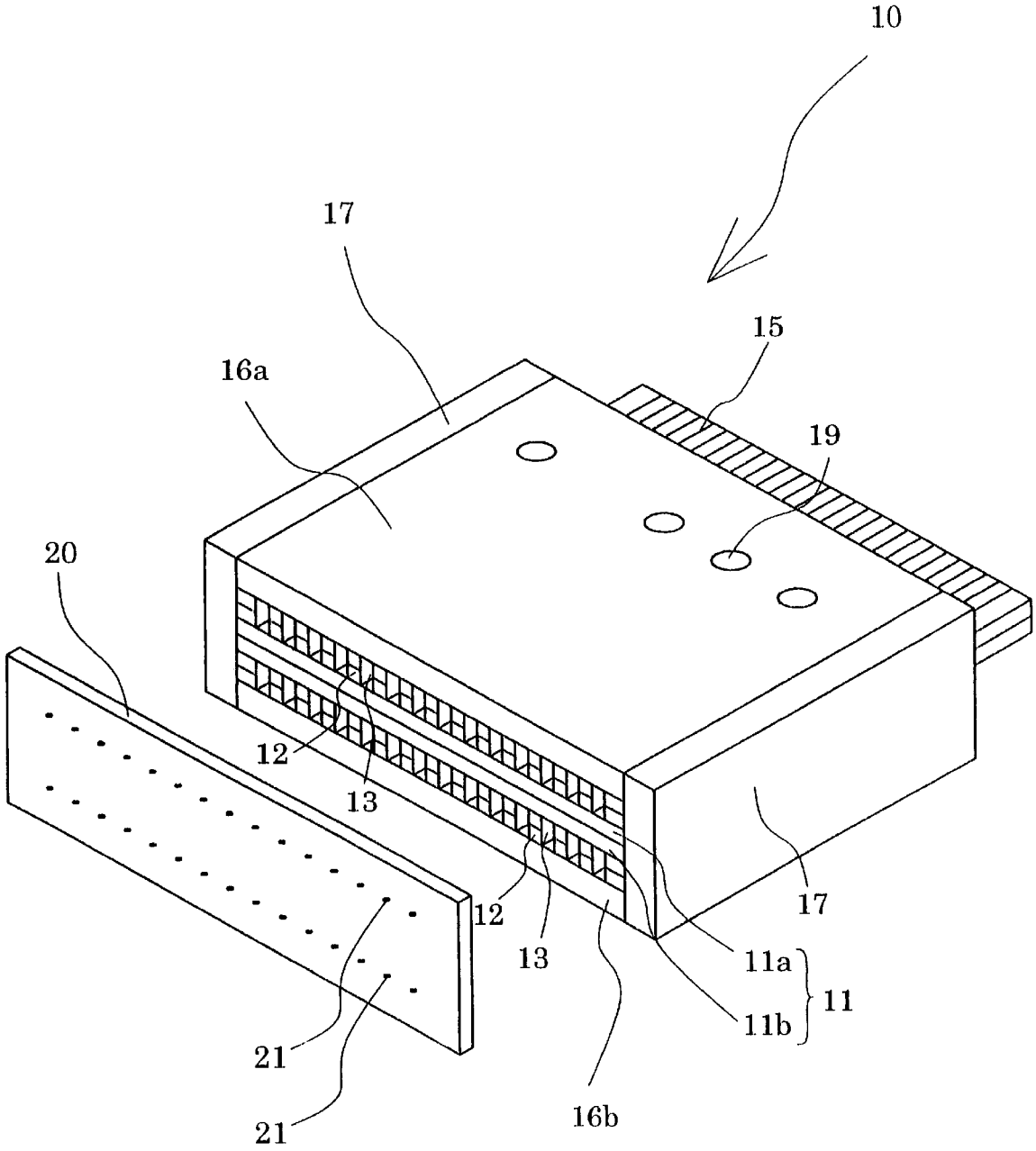
FIG. 1 is a perspective view showing a head chip according to Embodiment 1 of the present invention.
Figure 2:
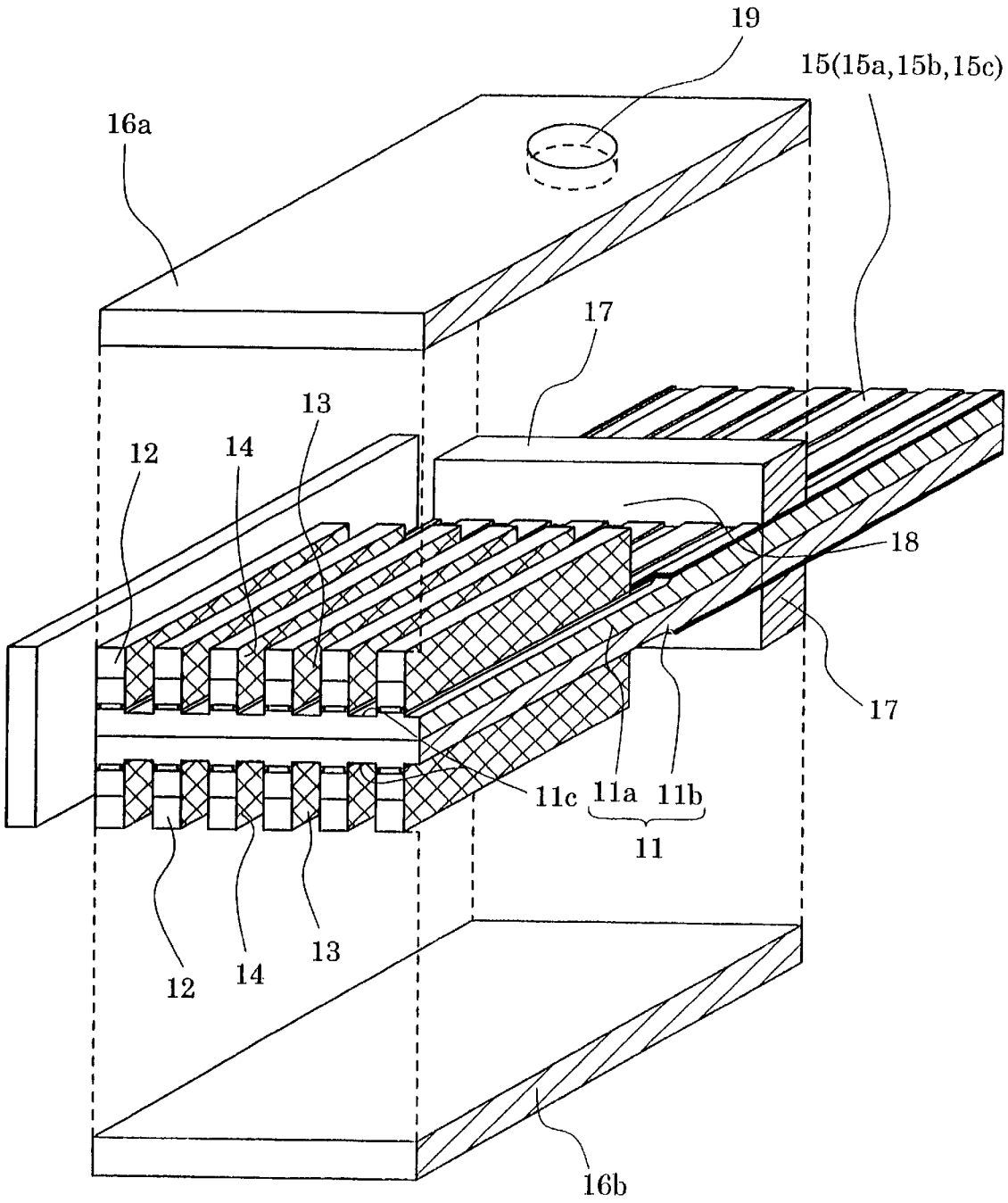
FIG. 2 is a sectional perspective view indicating the head chip according to Embodiment 1 of the present invention.
Figure 3:
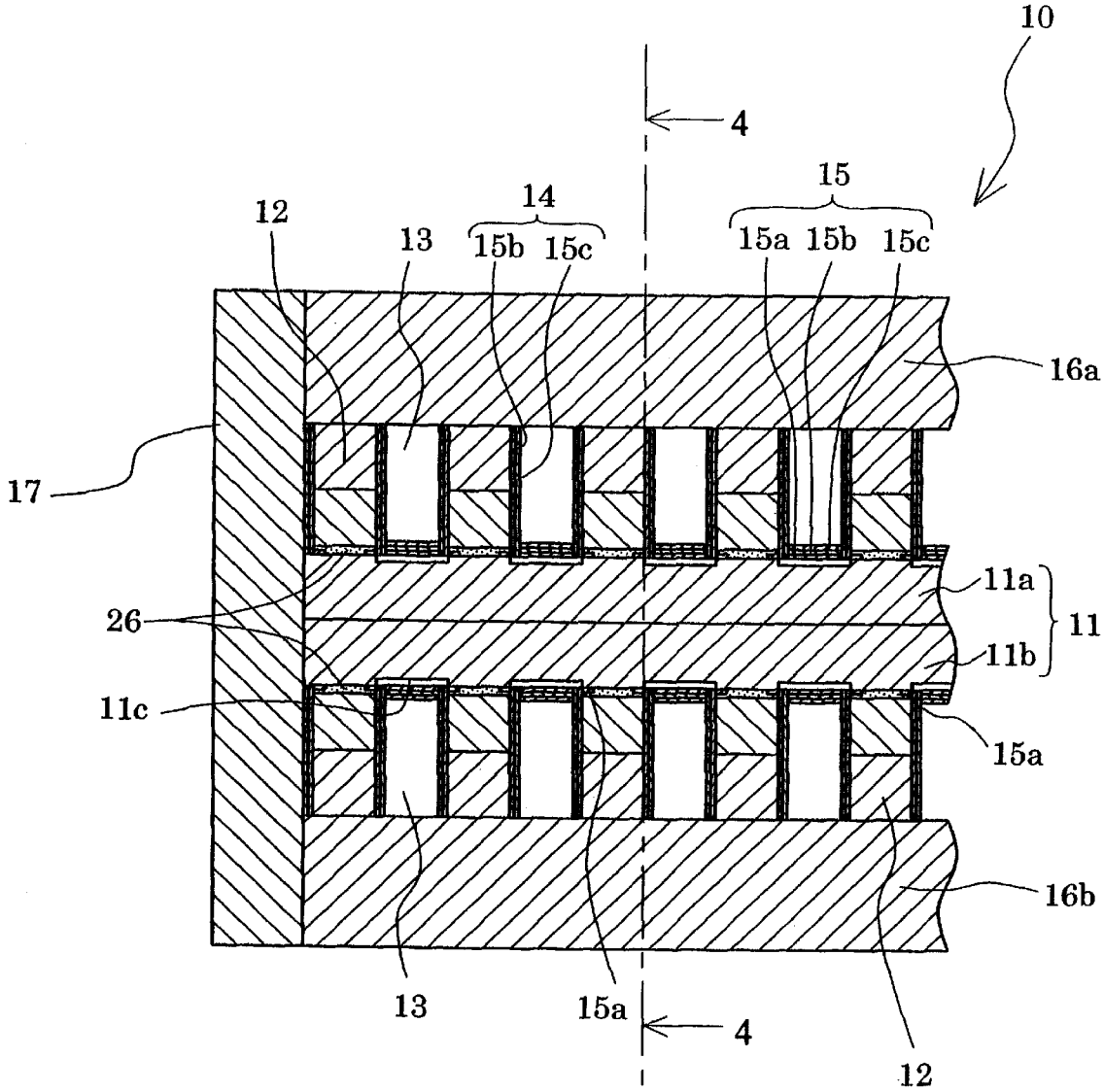
FIG. 3 is a sectional view representing the head chip according to Embodiment 1 of the present invention, taken along a parallel-arranging direction of a chamber.
Figure 4:
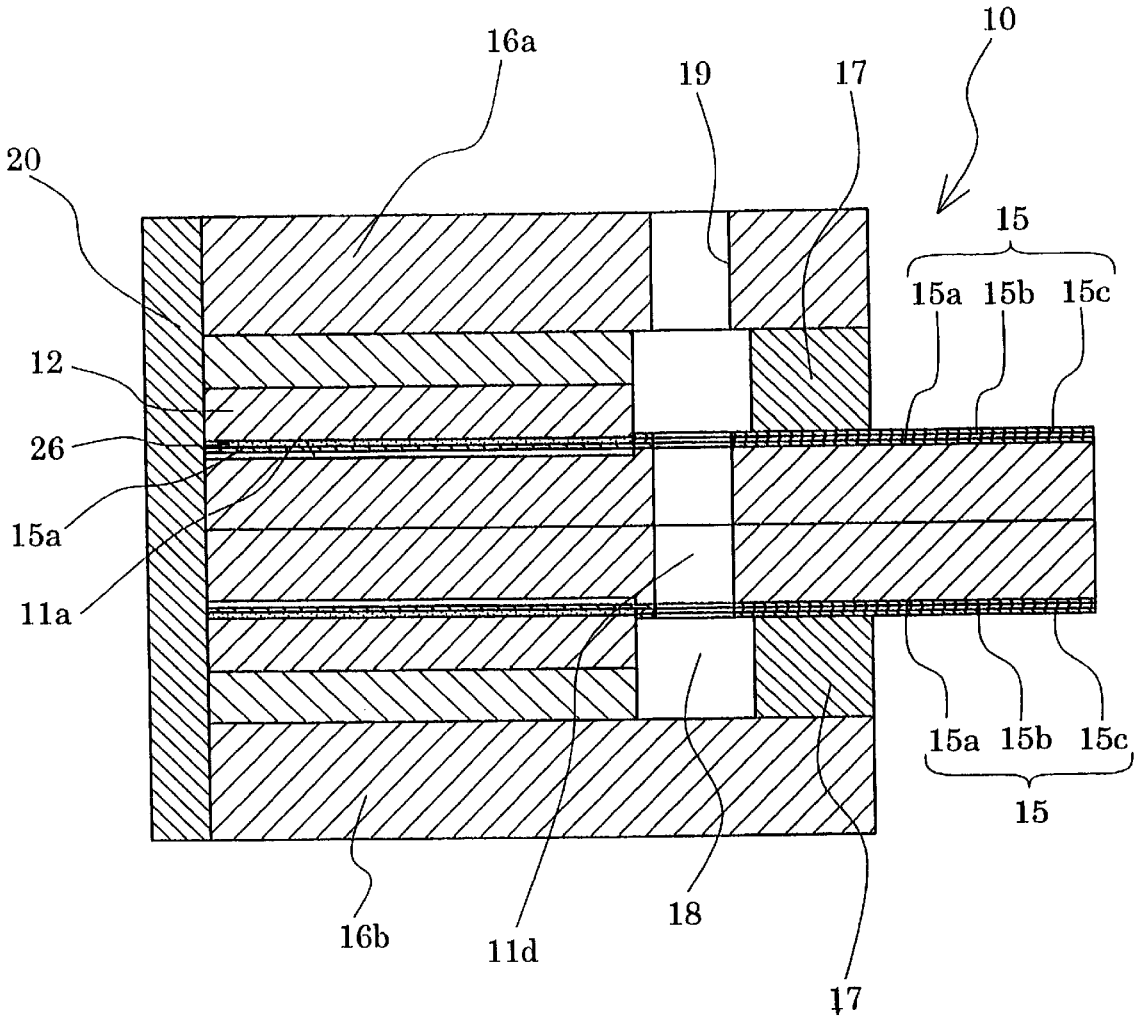
FIG. 4 is a sectional view taken along a line 4—4 of FIG. 3 according to Embodiment 1 of the present invention.

FIG. 1 is a perspective view indicating a head chip according to Embodiment 1 of the present invention. FIG. 2 is a sectional/perspective view of the head chip. FIG. 3 is a sectional view showing a chamber along a parallel-arranging direction. FIG. 4 is a sectional view taken along a line 4—4 of FIG. 3.

As shown in the figure, both surfaces of a plate-shaped flow path board 11 formed of a transparent dielectric material are provided with a plurality of channels or chambers 13 defined by partition walls 12 such that the partition walls 12 made of piezoelectric ceramic are arranged in parallel with predetermined intervals.

The flow path board 11 is formed by joining surfaces of two substrates or flow path boards 11*a* and 11*b* made of glass, on one side of which the partition walls 12 are formed. More specifically, the flow path boards 11*a*, 11*b* are joined at main surfaces thereof, and the partition walls 12 and chambers 14 are disposed on respective main surfaces of the flow path boards opposite the joined main surfaces.

A piezoelectric ceramic plate is adhered by an adhesive agent 26 in accordance with respective sides of the flow path boards 11*a* and 11*b* before bonding, and the partition walls 12 are formed by cutting the piezoelectric ceramic plate using, for example, a disk-shape dice cutter. At this time, in order to cut out the piezoelectric ceramic plate completely, the surfaces of the flow path boards 11*a* and 11*b* are ground by the dice cutter, and concave portions 11*c* corresponding to the respective chambers 13 are formed in the flow path boards 11*a* and 11*b*. Of course, only the piezoelectric ceramic plate is completely cut out and the concave portions 11*c* may not be formed. Also, separate partition walls 12 may be adhered with predetermined intervals.

This piezoelectric ceramic plate is formed by jointing two piezoelectric ceramic plates, having different polarization directions, in the thickness direction. Further, electrodes 14 for applying driving electric field are formed on the entire surface of the side surfaces of the partition walls 12, which are surfaces of the respective chambers 13.

Further, on the flow path board 11, wiring lines 15 are provided on the inner sides of end portions of the respective partition walls 12 in the longitudinal direction. The wiring line 15 has an inorganic conductive film 15*a* as the lowermost layer.

A transparent conductive film may be given, for example, as the inorganic conductive film 15*a*. As the transparent conductive film, ITO (oxide of indium and tin), $SnO_2$, ZnO, ATO (oxide of antimony and tin) or the like may be given. In this embodiment, ITO is used as the inorganic conductive film 15*a*. As to the wiring line 15, at least one layer of metal film formed by selective electrodes plating is formed on the inorganic conductive film 15*a*, and in this embodiment, two layers of a nickel metal film 15*b* and a gold metal film 15*c* are adopted.

In addition, although the electrode 14 is not particularly limited, it is formed of the nickel metal film 15*b* and the gold metal film 15*c*, which are formed together with the wiring 15 on the side surface of the partition wall 12 by the selective electrodes plating.

Here, the inorganic conductive film 15*a* is elongated along the chambers 13 defined on both sides between the flow path board 11 and the respective partitions 12, and the end portion of the inorganic conductive film 15*a* in the width direction is firmly in contact with the electrode 14. Thus, electrical conduction between the electrode 14 and the wiring line 15 is realized.

It should be noted that, although the inorganic conducive film 15*a*, that is elongated between the flow path board 11 and the partition wall 12, is provided a long the longitudinal direction of the partition wall 12, the present invention is not limited to this provided that the inorganic conductive film 15*a* is electrically conducted to the electrode 14 provided on the side surface of the partition wall 12. The inorganic conductive film 15*a* may be elongated to only one end of the electrode 14 in the longitudinal direction. Alternatively, the inorganic conductive film 15*a* may not be elongated between the flow path board 11 and the partition wall 12, and may be provided so as to be in contact with the end surface of the partition wall 12. In any case, it is only necessary that the electrode 14 is firmly conducted to the wiring line 15.

Further, guide walls 17 made of plastic, for example, are adhered to both side surfaces of the flow path board 11 and the inner portions of the flow path boards 11*a* and 11*b* at the end portions of the respective partition walls 12 in the longitudinal direction on the respective flow path boards 11*a* and 11*b* by an adhesive agent or the like. Then, ink chambers 18 that communicate with the respective chambers 13 are defined by the guide walls 17 and the partition walls 12 on each of the flow path boards 11*a* and 11*b*. It should be noted that the ink chambers 18 defined on the flow path boards 11*a* and 11*b* are communicated with the regions opposite to the ink chambers 18 of the flow path boards 11*a* and 11*b* via ink communication holes 11*d* formed therethrough.

Cover plates 16*a* and 16*b* made of glass having plate shape are jointed onto the partition walls 12 and the guide walls 17 formed on the flow path boards 11*a* and 11*b*, respectively, and the chambers 13 and the ink chambers 18 are sealed. Further, the cover plate 16*a* is provided with an ink supply port 19, which supplies ink to the ink chamber 18 defined on the flow path board 11*a* and is bored through the cover plate 16*a* in the thickness direction.

It should be noted that the ink supply port 19 of the cover plate 16*a* is formed by sandblasting in this embodiment.

Here in this embodiment, the chambers 13 are divided into groups corresponding to respective colors consisting of black (B), yellow (Y), magenta (M), and cyan (C), and four ink chambers 18 and four ink supply ports 19 are provided, respectively.

Further, one piece of nozzle plate 20 is jointed to the uniform entire surface of the end surfaces of the partition walls 12 and the end surface of the flow path board 11, and nozzle openings 21 are pierced in the nozzle plate 20 at the positions opposite to the respective chambers 13.

This nozzle plate 20 may be formed by, for example, plate-shaped metal, plastic, glass, or polyimide film. Further, although not shown in the figure, a water repelling film having a water repelling property is provided to the surface of the nozzle plate 20 opposing a subject to be printed, in order to prevent adhesion of ink or the like.

Here, an example of a manufacturing method of a head chip in accordance with the above embodiment will be explained in detail. It should be noted that FIG. 5 and FIG. 7 are top views showing manufacturing steps for forming the partition walls and the wiring lines on the flow path board 11*a* of the head chip. FIG. 6 and FIG. 8 are cross sectional views of the chamber 13 along the parallel-arranging direction, which correspond to the manufacturing steps of FIG. 5 and FIG. 7, respectively.

Figure 5A:
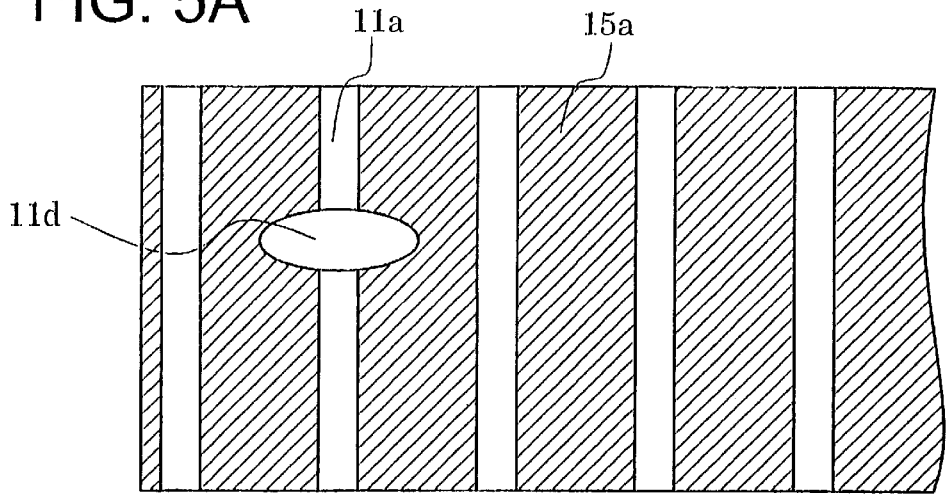
FIGS. 5A–5C is a top view showing a manufacturing method of the head chip according to Embodiment 1 of the present invention.
Figure 6A:
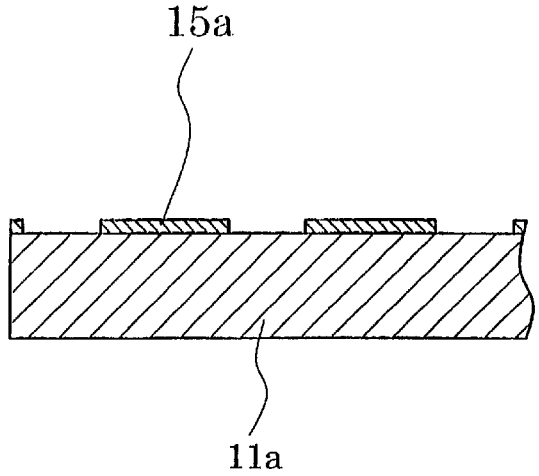
FIGS. 6A–6C is a sectional view representing the head chip corresponding to the respective manufacturing steps of FIG. 5 along the parallel-arranging direction of the chamber.

First, as shown in FIG. 5A and FIG. 6A, an ITO film that is the inorganic conductive film 15*a* is formed on the flow path board 11*a* in which the ink communication hole 11*d* is pierced in advance, and the ITO film is patterned with a predetermined shape, here with an interval that is slightly wider than that of the chamber 13.

There is no limitation on the forming method of the inorganic conductive film 15*a*. For example, after the inorganic conductive film 15*a* is formed by a sputtering method, application method or the like, it may be patterned with photolithography or the like.

Figure 5B:
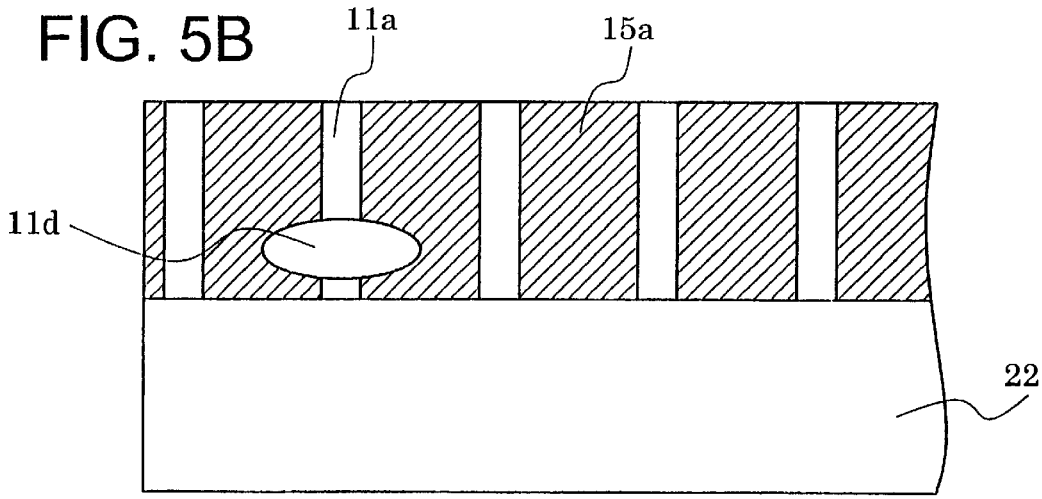
Figure 6B:
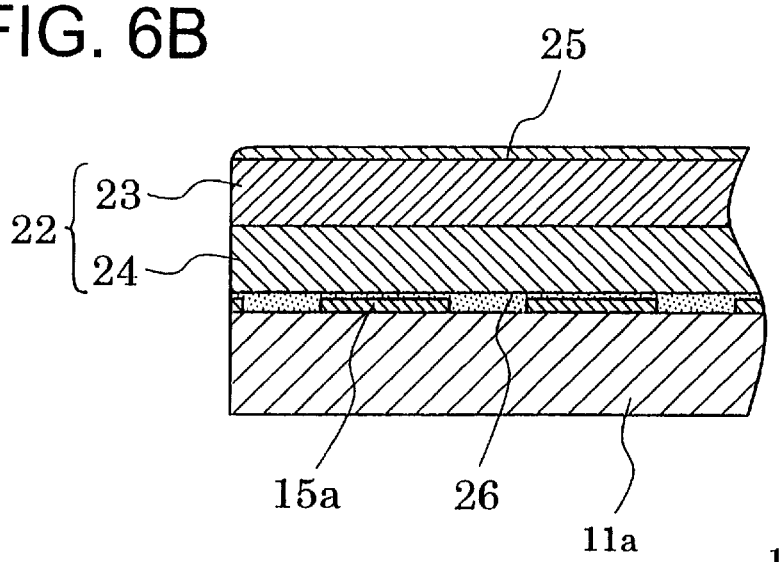

Next, as shown in FIG. 5B and FIG. 6B, a piezoelectric ceramic plate 22 in which surfaces other than a bonding surface are coated with a resist 25 is adhered onto the inorganic conductive film 15*a* by the adhesive agent 26. This piezoelectric ceramic plate 22 is formed by jointing two sheets of piezoelectric ceramic plates 23 and 24 having different polarization directions in the thickness direction, the surfaces other than the bonding surface are coated with the resist 25, and then the piezoelectric ceramic plate 22 is adhered to the flow path board 11 by the adhesive agent 26. It should be noted that the resist 25 may be provided after the piezoelectric ceramic plate 22 is adhered to the flow path board 11.

Figure 5C:
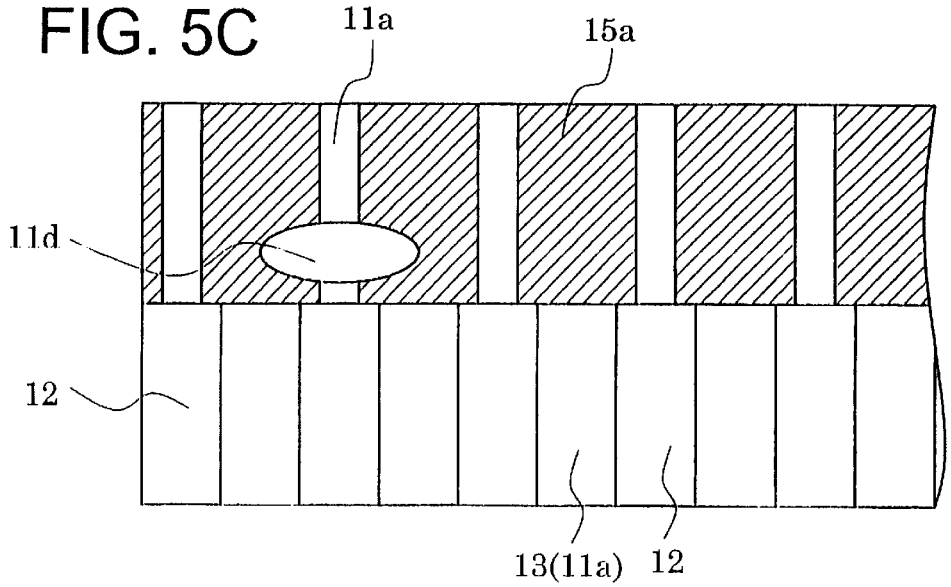
Figure 6C:
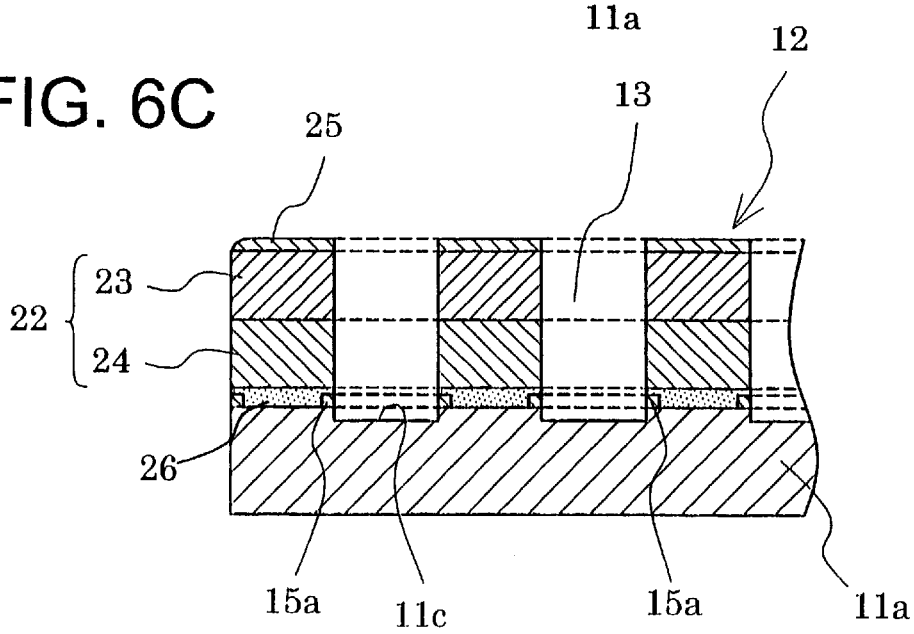

Thereafter, as shown in FIG. 5C and FIG. 6C, the piezoelectric ceramic plate 22 is cut out to form the partition walls 12 and chambers 13. In this embodiment, for example, the piezoelectric ceramic plate 22 is cut out in the thickness direction with the width that is narrower by a predetermined width than the width of the inorganic conductive film 15*a* by using the disk-shape dice cutter to thereby form the partition walls 12 and chambers 13.

At this time, the inorganic conductive film 15*a* is cut out to the surface of the flow path board 11*a* in order that the inorganic conductive film 15*a* provided on the flow path board 11*a* is not electrically conducted within the chambers 13. Thus, concave portions 11*c* are formed. Of course, the inorganic conductive film 15*a* may be previously patterned into the cut-out condition.

Further, when the partition walls 12 are formed, since the piezoelectric ceramic plate 22 is cut out with the width that is narrower by a predetermined width than the width of the inorganic conductive film 15*a*, the inorganic conductive film 15*a* remains between both the end portions of the partition walls 12 in the width direction and the flow path board 11 along the longitudinal direction, and the side surfaces are exposed. Then, the inorganic conductive films 15*a* formed on both sides of the respective chambers 13 are continuous with the inorganic conductive films 15*a* that become the wiring lines 15 at the rear of the partition walls 12 as shown in FIG. 6C.

Figure 7A:
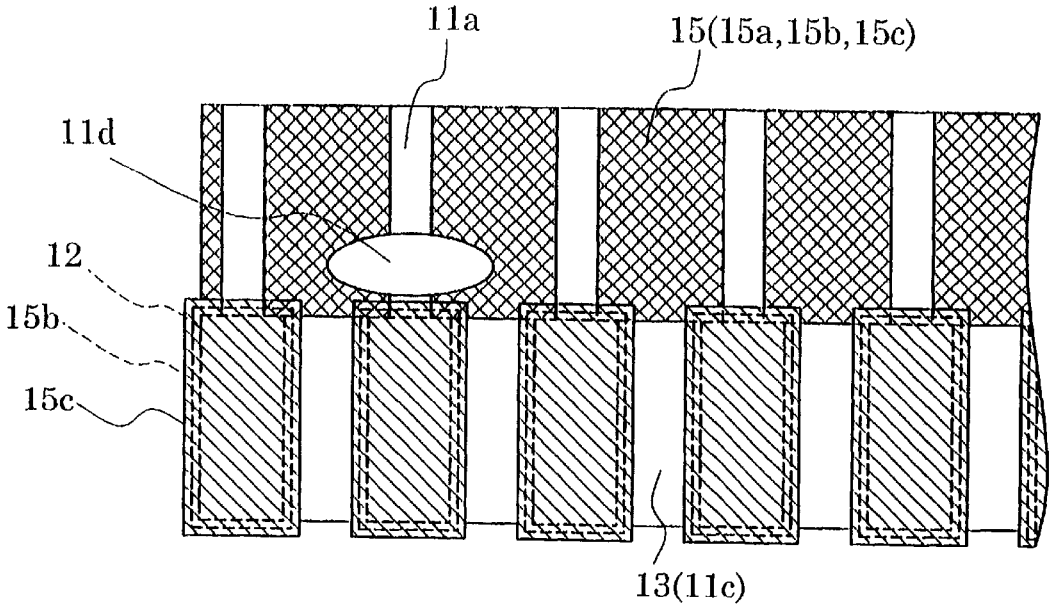
FIGS. 7A–7B is a top view showing a manufacturing method of the head chip according to the embodiment of the present invention.
Figure 8A:
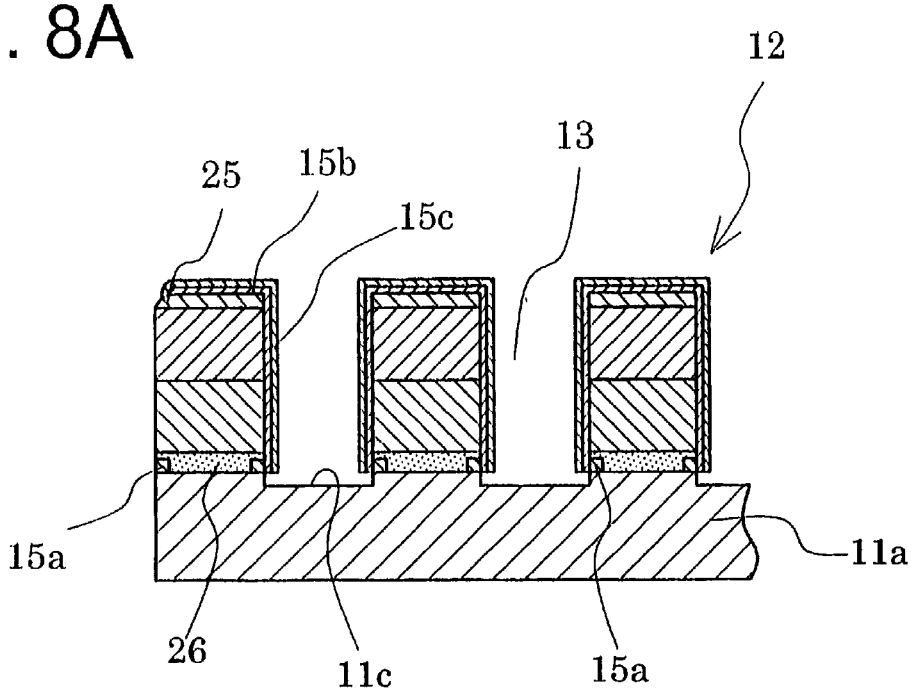
FIGS. 8A–8B is a sectional view representing the head chip corresponding to the respective manufacturing steps of FIG. 7 along the parallel-arranging direction of the chamber.

Next, as shown in FIG. 7A and FIG. 8A, a starting catalyst containing palladium, platinum or the like is absorbed over the entire surfaces of both the partition walls 12 and the inorganic conductive films 15*a*, namely surfaces other than the surface of the flow path board 11*a*. Thereafter, the nickel metal film 15*b* and the gold metal film 15*c* are formed by selective electrodes plating.

The wiring line 15 of three layers that is constituted of the inorganic conductive film 15*a*, the nickel metal film 15*b* and the gold metal film 15*c* is formed by this selective electrodes plating, and the two layers of the nickel metal film 15*b* and the gold metal film 15*c* are formed over the entire surface of the partition wall 12. Further, the metal films 15*b* and 15*c* provided over the entire surface of the partition wall 12 are electrically conducted to the inorganic conductive film 15*a* provided between the partition wall 12 and the flow path board 11*a* at the exposed side surface.

Figure 7B:
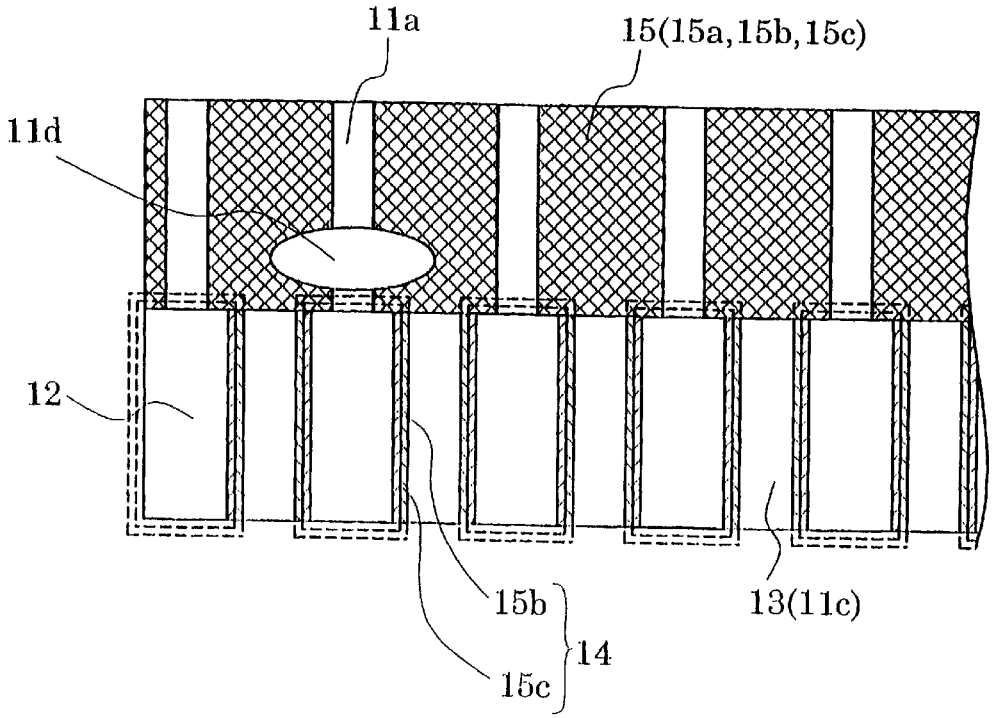
Figure 8B:
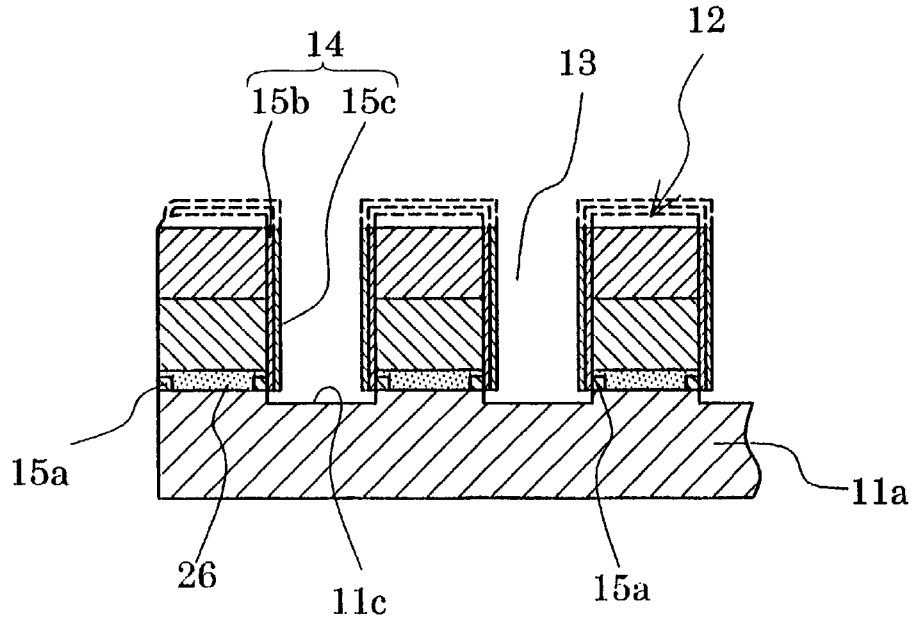

Next, as shown in FIG. 7B and FIG. 8B, the resist 25, which is formed on both the upper surface of the partition wall 12 and the end surfaces of the partition wall 12 along the longitudinal direction, and also the unnecessary metal films 15*b* and 15*c* formed on the resist 25 are lifted off. As a result, such an electrode 14, which is not short-circuited on both the side surfaces of the partition wall 12 and which is constructed of two layers made of the nickel metal film 15*b* and the gold metal film 15*c*, is formed.

As previously explained, both the electrode films 15*b* and 15*c* which constitute the electrode 14 formed in this manner are electrically conducted with the inorganic conductive film 15*a* on the exposed side surfaces thereof. In other words, the electrode 14 is mutually and electrically conducted via the inorganic conductive film 15*a* to the wiring line 15.

Thereafter, the partition walls 12 and the wiring lines 15 are also formed on the flow path board 11*b* by the above-mentioned steps. As shown in FIG. 1 to FIG. 4, the surfaces of the flow path boards 11*a* and 11*b*, in which the partition walls 12 and the wiring lines 15 are formed on the other surfaces thereof, are jointed to each other by the adhesive agent such that the end surfaces in which the partition walls 12 are formed, are made flush with each other.

At this time, since the flow path boards 11*a* and 11*b* are formed of a transparent dielectric material, and formed of glass in this embodiment, alignment of the chambers 13 arranged in parallel on the flow path boards 11*a* and 11*b* can be performed visually with ease from the surfaces of the flow path boards 11*a* and 11*b* incomparison with the end surfaces of the flow path boards 11*a* and 11*b*. Therefore, the positions of the chambers 13 are not shifted, and the assembly can be performed with high precision.

Thereafter, the guide walls 17 made of plastic are adhered to both the end surfaces of the partition walls 12 of the flow path board 11 in the parallel-arranging direction and at the rear of the partition walls 12 by the adhesive agent or the like to define the ink chambers 18 on the flow path boards 11*a* and 11*b*. Then, the cover plates. 16*a* and 16*b* are adhered onto the partition walls 12 by the adhesive agent or the like so as to sandwich the flow path board 11 on which the partition walls 12 are formed. Also, the plate-shape nozzle plate 20 in which the nozzle openings 21 are pierced with respect to each of the chambers 13 is adhered to the end surface of the flow path board 11 at the side on which the partition walls 12 are provided by the adhesive agent or the like. Then, the outer shape of the resultant head chip is processed by dicing, and thus, a head chip 10 is manufactured.

As explained above, in this embodiment, the partition walls 12 are formed on the flow path boards 11*a* and 11*b*, respectively, and the flow path boards 11*a* and 11*b* are visually jointed together. Thus, the positions of the chambers 13 can be easily aligned without fail.

The head chip formed as described above may be provided with twice as many nozzle openings 21 as compared with the head chip in which chambers are formed on only one surface. Therefore, the recording density can be improved.

In addition, the manufacturing cost can be reduced by using a large amount of low-cost glass.

Furthermore, driving principle etc. of the head chip 10 are as described in the prior art, and therefore, the description thereof is omitted here.

Figure 9:
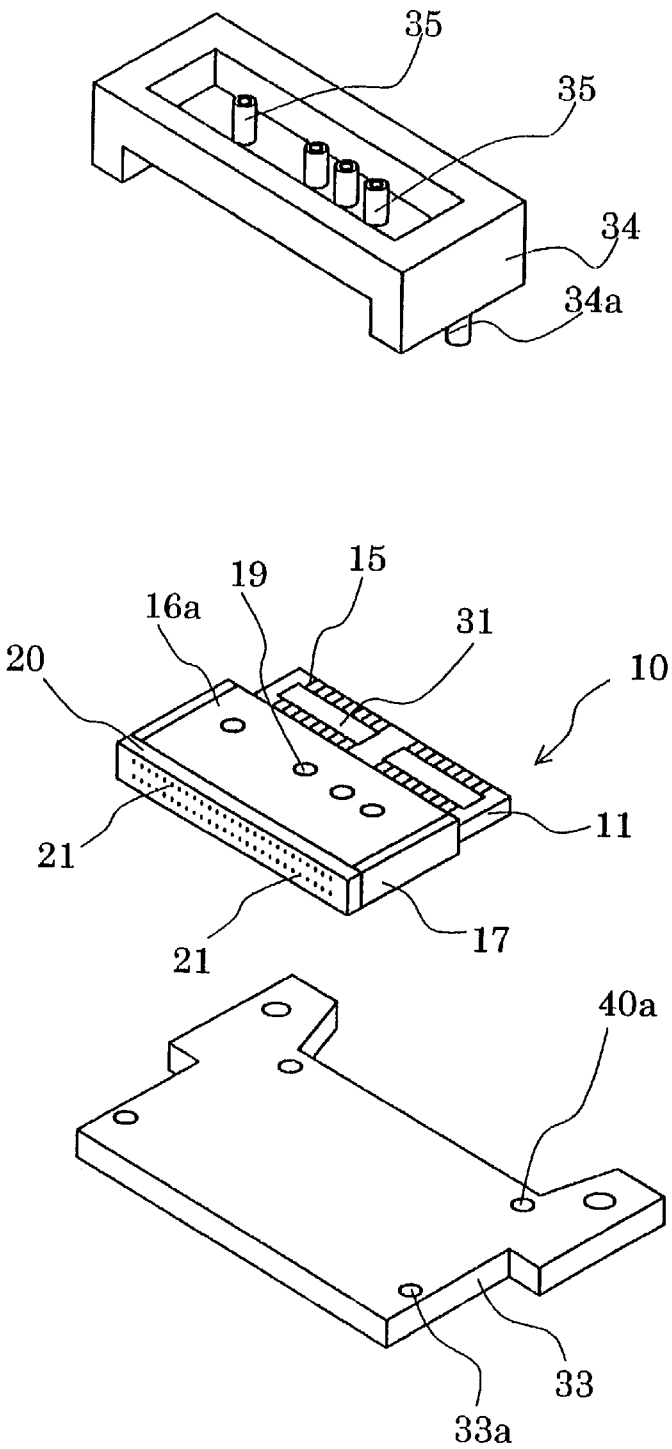
FIG. 9 is a perspective view indicating an assembly of a unit with employment of the head chip according to Embodiment 1 of the present invention.

FIG. 9 is an exploded perspective view indicating a head chip unit on which the above-explained head chip 10 is mounted.

As illustrated in FIG. 9, a driver circuit 31 such as an integrated circuit for driving the head chip 10 is directly connected to the wiring line 15, and this driver circuit 31 is mounted on the glass board 11 of the head chip 10. Also, a bass plate 33 made of aluminum is assembled on the side of the glass board 11, and a head cover 34 is assembled on the side of the cover plate 16 in the head chip 10. The base plate 33 is fixed to the head cover 34 such that an engaging shaft 34*a* of the head cover 34 is engaged with an engaging hole 33*a* of the base plate 33, and the head chip 10 is sandwiched by both the base plate 33 and the head cover 34. An ink conducting path 35 is formed on the head cover 34, and this ink conducting path 35 is communicated with each of the ink supply ports 19 of the cover plate 16.

Also, such a head chip unit 40 may be assembled with, for example, a tank holder, which detachably holds an ink cartridge, to be used.

Figure 10A:
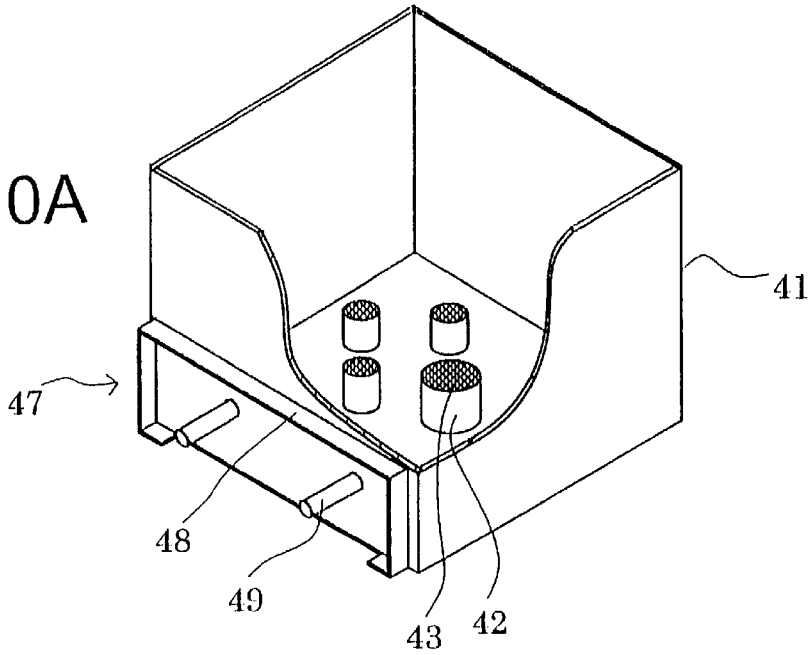
FIGS. 10A–10B is a perspective view indicating an assembly of a unit with employment of the head chip according to Embodiment 1 of the present invention.
Figure 10B:
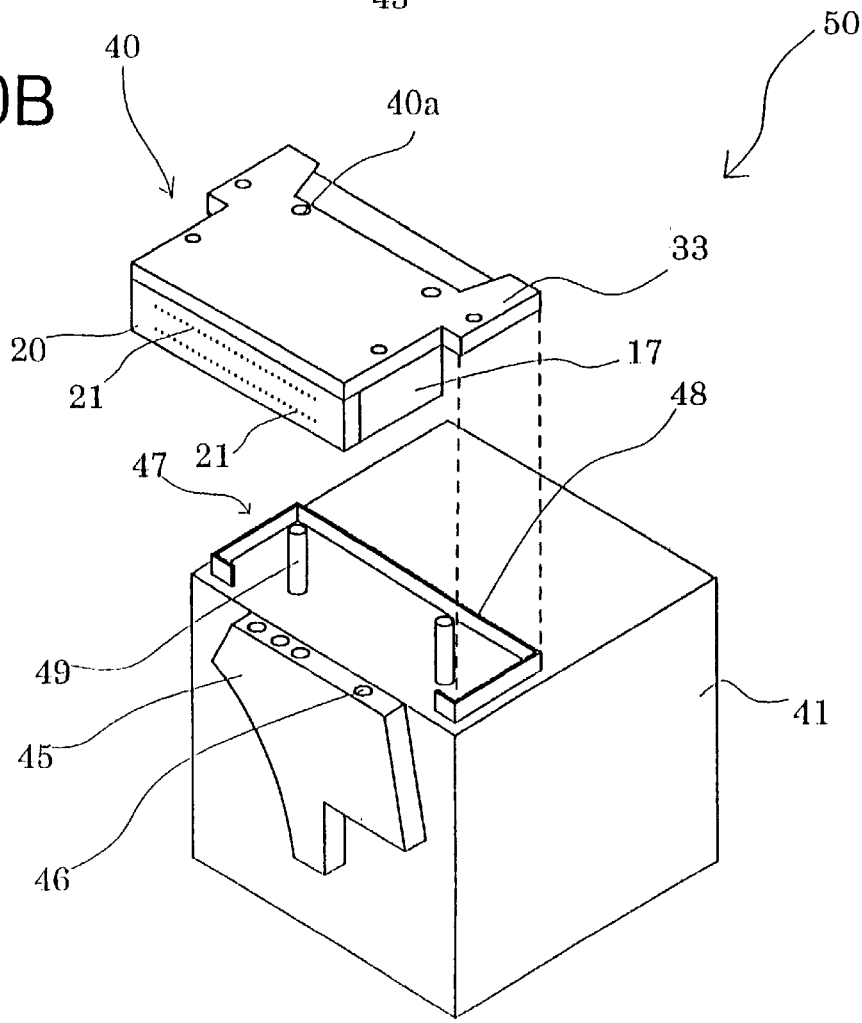

FIG. 10A shows an example of such a tank holder. FIG. 10B shows the tank holder 41 and the head chip unit 40 which is assembled with the tank holder 41. The tank holder 41 shown in FIG. 10 is formed to have substantially a box shape whose one surface is opened, and an ink cartridge (not shown) may be detachably held. A coupling portion 42 is provided on an upper surface of a bottom wall, and is coupled to the ink supply port 19 corresponding to an opening portion formed in the bottom portion of the ink cartridge. A plurality of the coupling portions 42 are provided with respect to each of color ink, for instance, black (B) ink, yellow (Y) ink, magenta (M) ink, and cyan (C) ink. An ink flow path (not shown) is formed inside the coupling portion 42, and a filter 43 is provided at a tip portion of the coupling portion 42 which constitutes an opening of this ink flow path. The ink flow path formed inside the coupling portion 42 is communicated to the rear surface of the bottom wall. The respective ink flow paths are communicated to a head coupling port 46 which is opened in the partition wall of a flow path board 45 via an ink flow path (not shown) which is provided within the flow path board 45 provided on the side of the rear surface of the tank holder 41. This head coupling port 46 is opened on the side of the side surface of the tank holder 41, and a head chip unit holding portion 47 which holds the above-described head chip unit 40 is provided on the bottom portion of this partition wall. In the head chip unit holding portion 47, there are provided a surrounding wall 48 and an engaging shaft 49. The surrounding wall 48 surrounds the driver circuit 31 provided on the glass board 11, and is formed into substantially a U-shape and positioned in an upright manner. The engaging shaft 49 is engaged with an engaging hole 40a formed in the base plate 33 of the head chip unit 40 provided inside the surrounding wall 48.

As a consequence, the head chip unit 40 is mounted on this head chip unit holding portion 47, so that a head unit 50 can be completed. At this time, the ink conducting path 35 formed in the head cover 34 is coupled to the head coupling port 46 of the ink board 45. As a result, the ink which is conducted from the ink cartridge via the coupling portion 42 of the tank holder 41 is conducted via the ink flow path formed in the ink board 45 into the ink conducting path 35 of the head chip unit 40, so that this ink is filled into both the ink chambers 18 and the chambers 13.

Second Embodiment

In Embodiment 1 described above, the partition walls 12 are provided on the flow path boards 11*a* and 11*b*, respectively, and the flow path boards 11*a* and 11*b* are jointed to each other. Embodiment 2 is the same as Embodiment 1 described above other than the point that the partition walls 12 are arranged in parallel on both the surfaces of the flow path board 11*a*.

Figure 11:
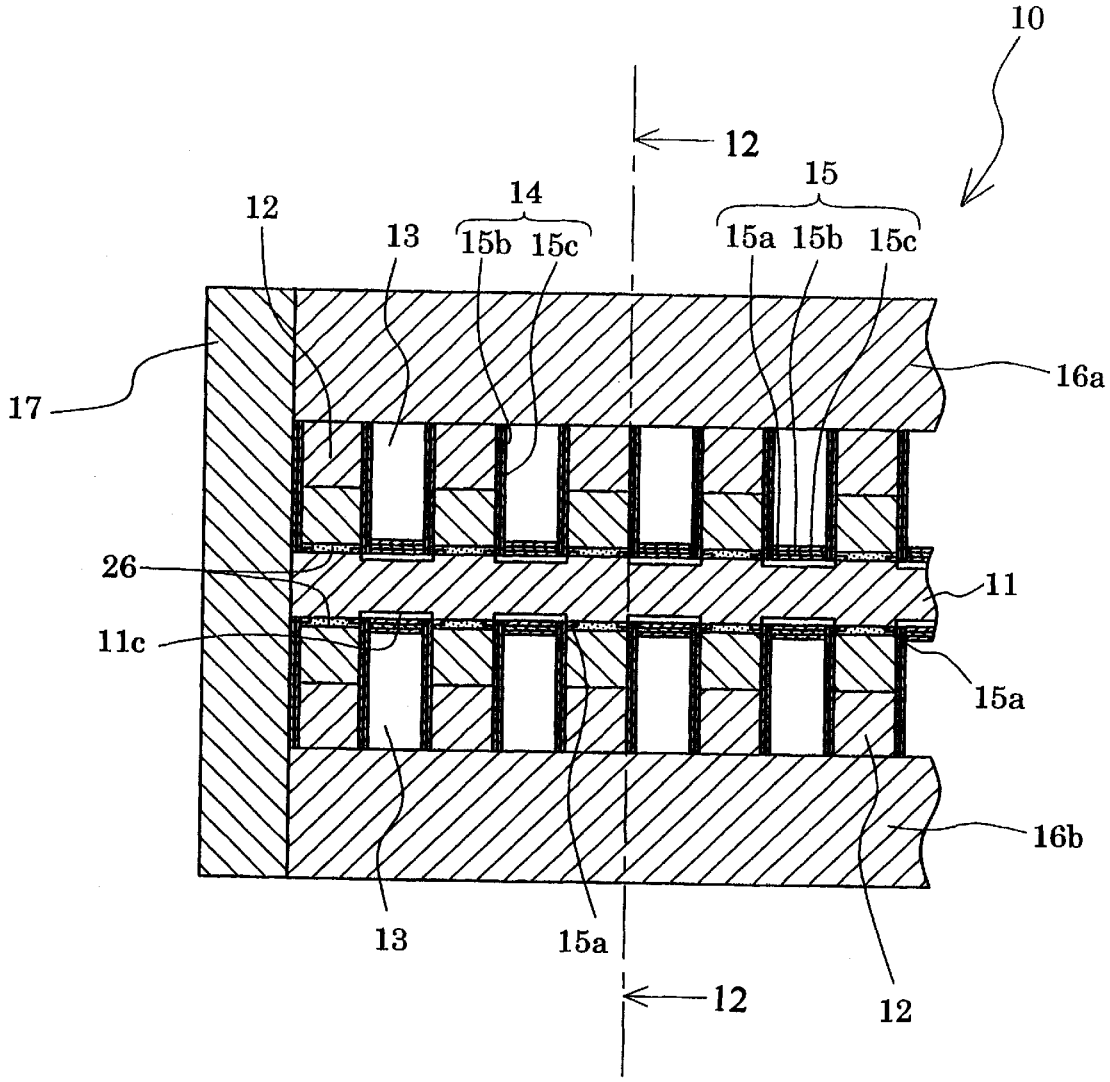
FIG. 11 is a sectional view representing a head chip according to Embodiment 2 of the present invention, taken along a parallel-arranging direction of a chamber.
Figure 12:
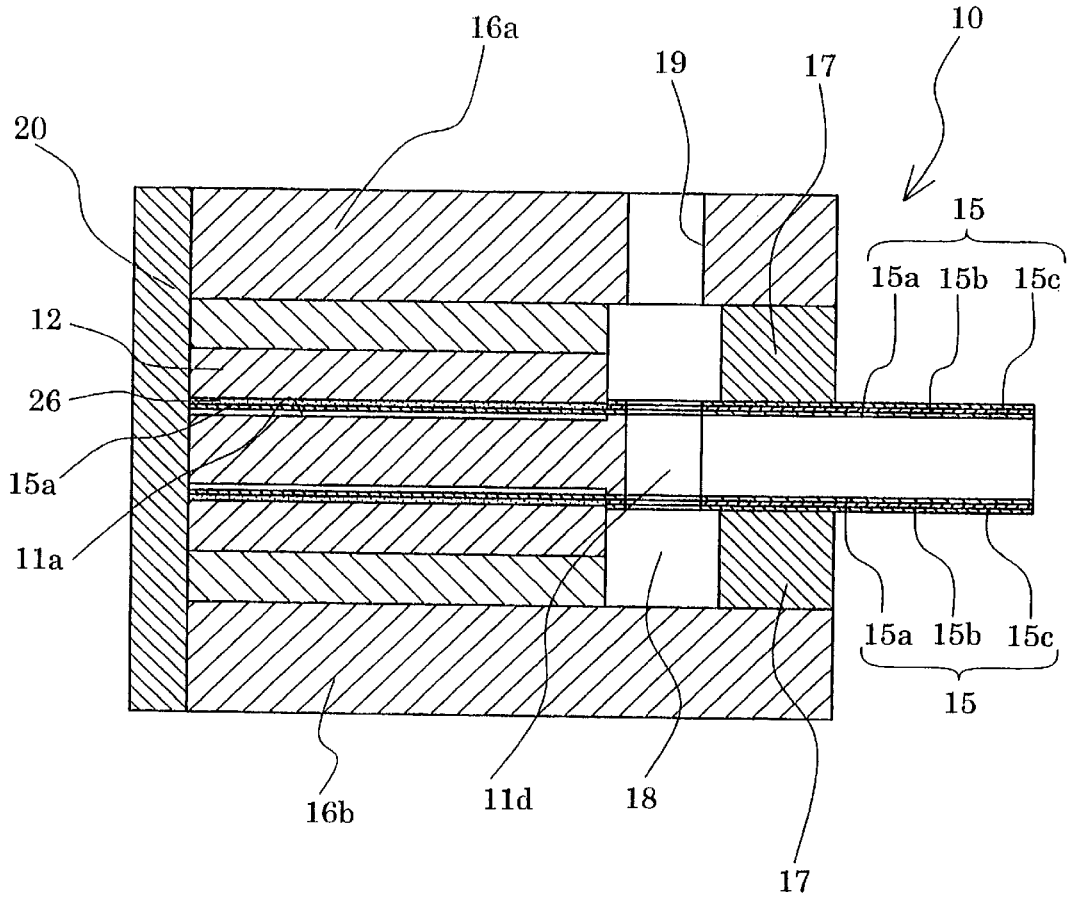
FIG. 12 is a sectional view taken along a line 12 of FIG. 11 according to Embodiment 2 of the present invention.

FIG. 11 is a cross sectional view of chambers of a head chip in accordance with Embodiment 2 along the parallel-arranging direction. FIG. 12 is a cross sectional view taken along the line 12—12 of FIG. 11.

As shown in the figure, in the head chip of Embodiment 2, the partition walls 12 are arranged in parallel on both surfaces of the flow path board 11 with predetermined intervals.

The partition walls 12 are formed by, for example, cutting a piezoelectric ceramic plate, and are respectively adhered to the flow path board 11 by the adhesive agent 26 so as to be aligned to one side of the flow path board 11 with the predetermined intervals.

It should be noted that the forming method of the partition walls 12 is not limited to this. For example, the piezoelectric ceramic plate may be adhered to both the surfaces of the flow path board 11 by the adhesive agent 26, and then cut using a wire saw.

In any case, when the partition walls 12 are provided on both the surfaces of the flow path board 11, which is a transparent dielectric material, since the flow path board 11 is transparent, the positions of the partition walls 12 on both the surfaces can be visually confirmed with ease.

Other Embodiment

The head chip according to the present invention is explained as described above. However, the present invention is not limited to Embodiments 1 and 2 described above.

For example, in Embodiments 1 and 2 described above, the flow path board 11 is made of glass. However, there is no limitation on the material for the flow path board provided that one surface of the flow path board may be visually confirmed from the other surface.

Further, in Embodiments 1 and 2, the metal films 15*b* and 15*c* by selective electrodes plating are used as a part of the wiring line 15 and the electrode 14. However, there is no limitation on this. For example, as to the wiring line, a wiring board on which wiring patterns are formed in advance may be adhered onto the flow path board, and as to the electrode, the metal films may be formed by a known vapor deposition in an oblique direction.

Figure 13:
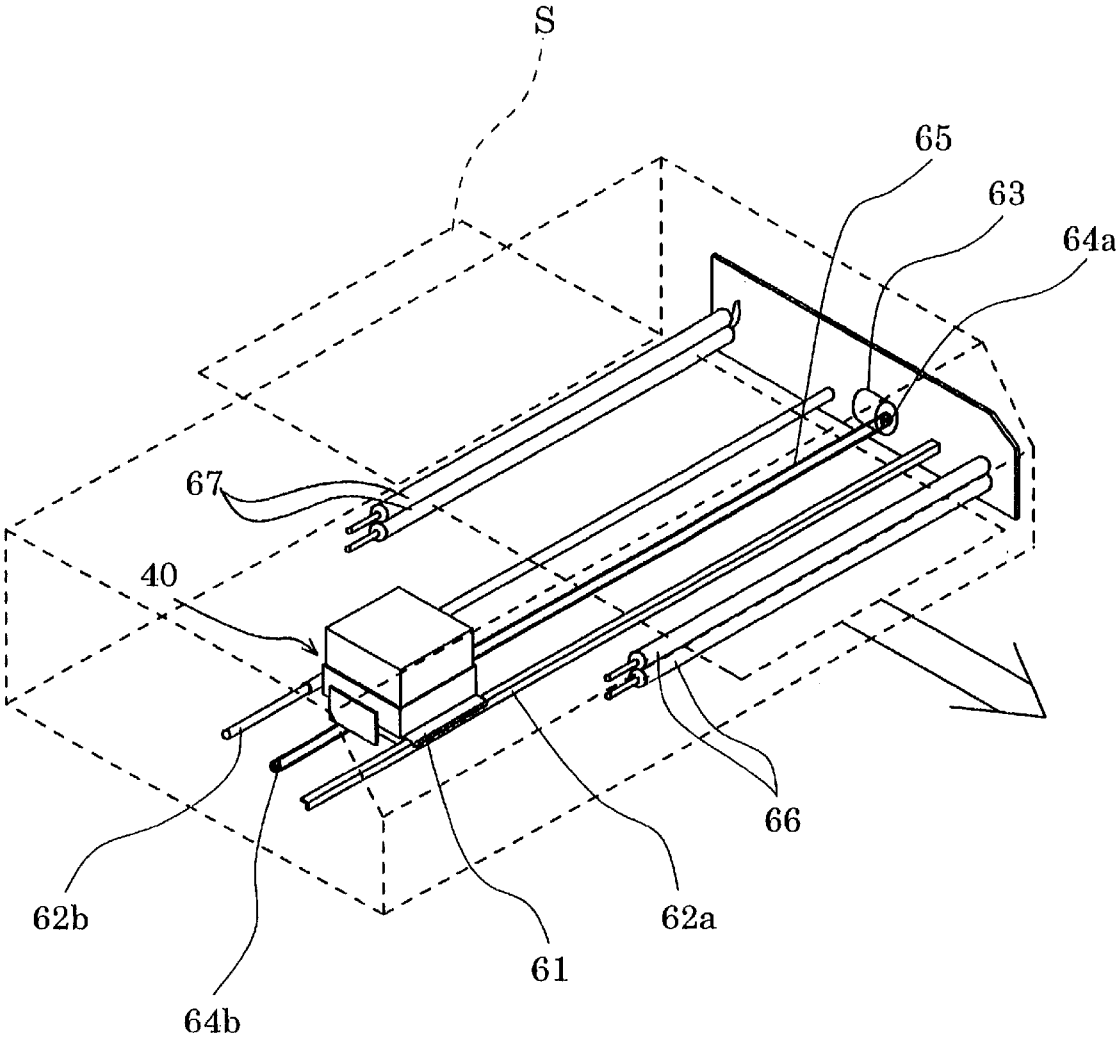
FIG. 13 is a perspective view showing a use mode of a unit employing a head chip according to other embodiment of the present invention.
Figure 14:
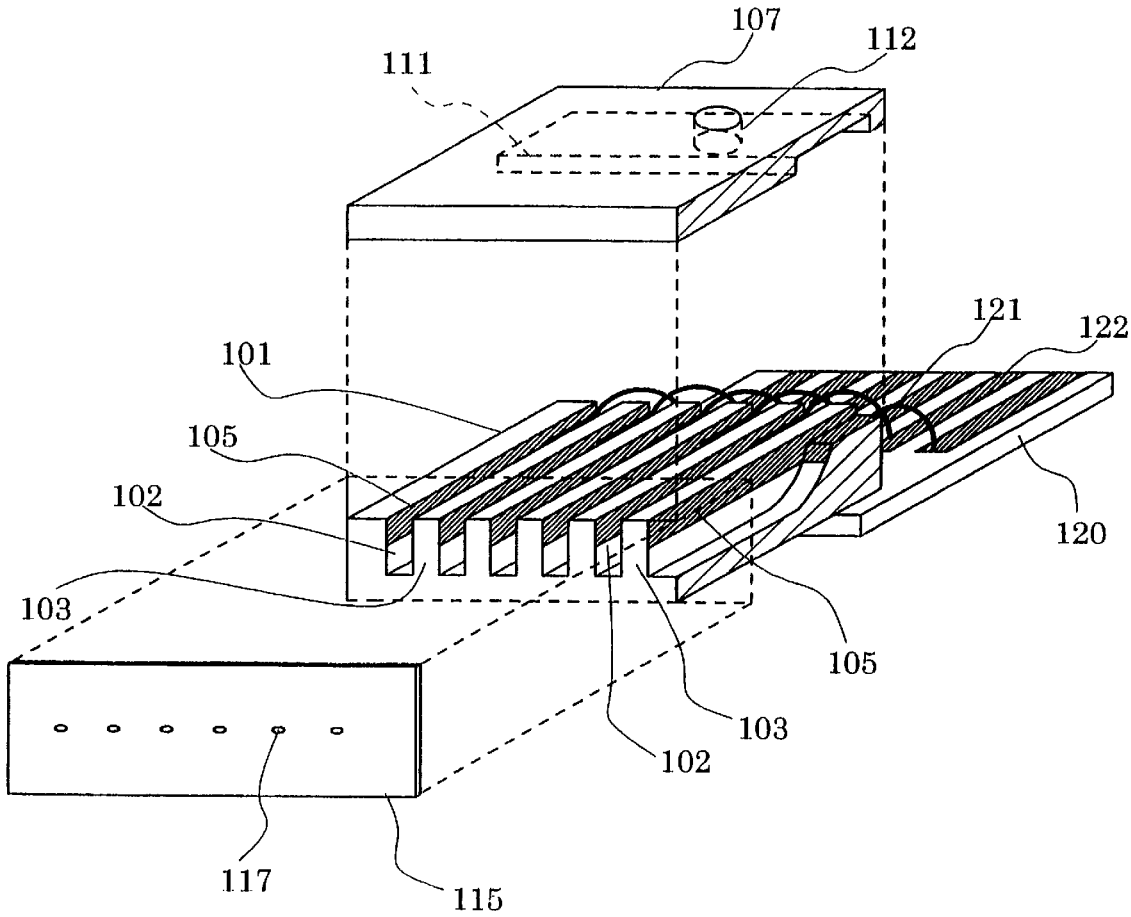
FIG. 14 is an exploded perspective view schematically showing a recording head in accordance with a conventional technique.
Figure 15A:
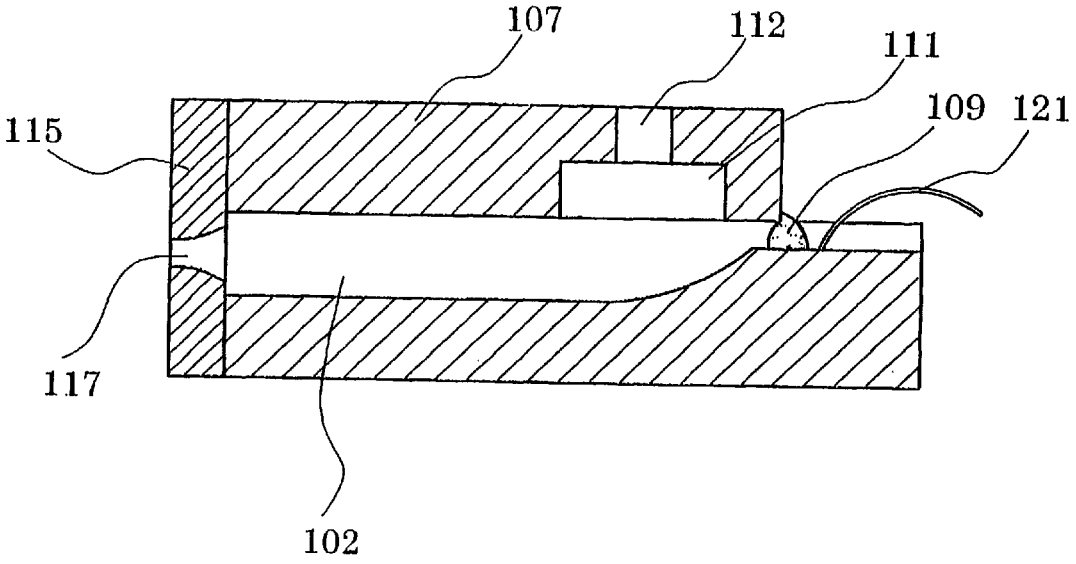
FIG. 15A PRIOR ART
FIGS. 15A–15B is a sectional view schematically indicating the recording head in accordance with the conventional technique.
Figure 15B:
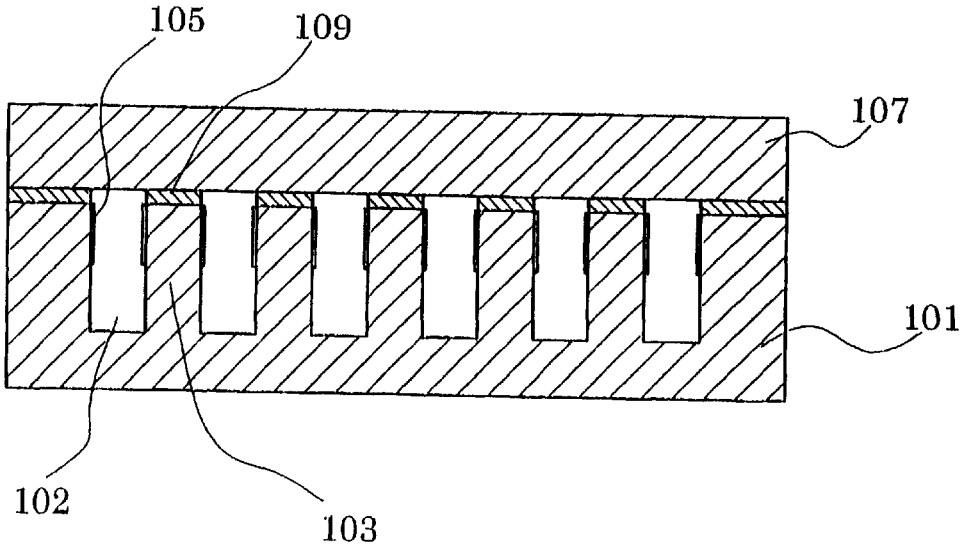
FIG. 15B PRIOR ART
Figure 16:
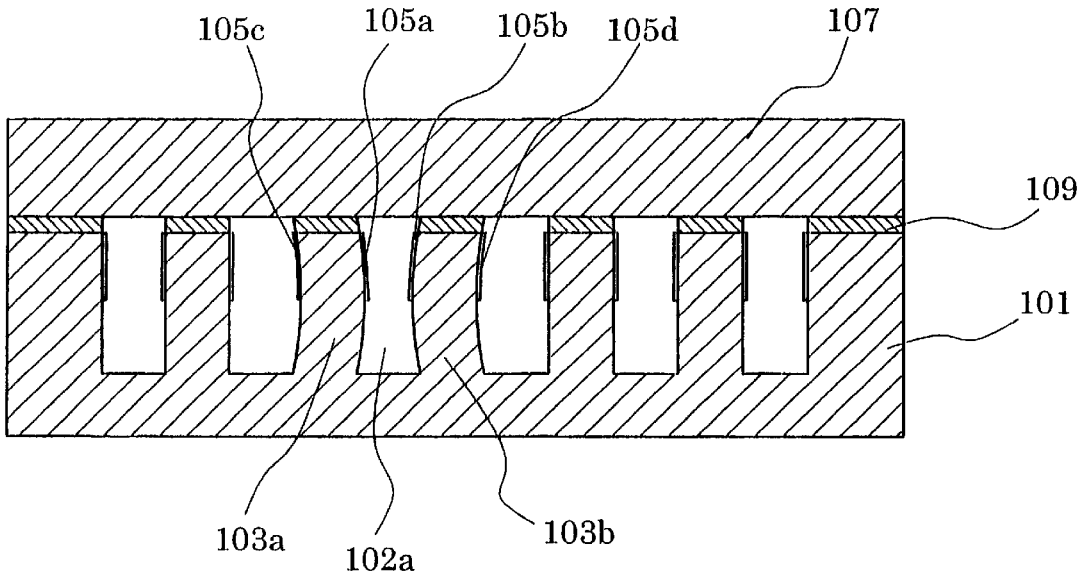
FIG. 16 is a sectional view schematically indicating the recording head in accordance with the conventional technique.

Such a head unit 50 is mounted on, for example, a carriage of an ink-jet type recording apparatus so as to be used. FIG. 13 schematically shows an example of this use mode of the head unit 50.

As shown in FIG. 13, a carriage 61 is movably mounted on one pair of guide rails 62*a* and 62*b* along a shaft direction. This carriage 61 is transported by way of a timing belt 65 which is suspended between a pulley 64*a*, that is provided on one end side of the guide rail 62, and is coupled to a carriage driving motor 63, and another pulley 64*b* that is provided on the other side of this guide rail 62. A pair of transfer rollers 66 and 67 are provided along the guide rails 62*a* and 62*b* on both sides in a direction perpendicular to the transport direction of the carriage 61. These transfer rollers 66 and 67 are used to transport a recording medium "S" located below the carriage 61 along a direction perpendicular to the transport direction of this carriage 61.

The above-explained head unit 50 is mounted on the carriage 61, and the above-explained ink cartridge may be detachably mounted on this head unit 50.

In accordance with such an ink-jet type recording apparatus, while the recording medium "S" is fed, the carriage 61 is scanned along the direction perpendicular to this medium feeding direction, so that both a character and an image can be recorded on this recording medium "S" by the head chip.

While the present invention has been described with the embodiment, the present invention is not limited to the construction described above.

As explained above, in the present invention, the chambers are arranged in parallel on the board having a light transmitting property with the predetermined intervals, and a plurality of the boards are laminated in the vertical direction. Therefore, the alignment of the chambers can be easily performed with high precision, and the head having high density can be formed.

What is claimed is:

1. A head chip comprising:

a first-substrate having a first main surface and a second main surface opposite the first main surface;

a second substrate having a first main surface and a second main surface opposite the first main surface and disposed on the second main surface of the first substrate;

a plurality of first partition walls disposed on the first main surface of the first substrate and spaced apart at a preselected interval to form a plurality of first channels each for receiving ink and having a pair of side walls;

a plurality of second partition walls disposed on the first main surface of the second substrate and spaced apart at a preselected interval to form a plurality of second channels each for receiving ink and having a pair of side walls; and a plurality of electrodes connected to the side walls of the first and second channels and driven by a voltage signal to deform the side walls to vary the volume in the first and second channels to thereby eject ink from the first and second channels.

2. A head chip according to claim 1; wherein the first and second substrates are made of a transparent dielectric material.

3. A head chip according to claim 2; wherein the first and second partition walls are made of piezoelectric ceramic.

4. A head chip according to claim 1; wherein the first and second partition-walls are made of piezoelectric ceramic.

5. A head chip according to claim 1; further comprising a nozzle plate having a first surface connected to the first and second substrates, a second surface disposed opposite the first surface, and a plurality of nozzle openings each extending through the first and second surfaces of the nozzle plate and disposed in communication with respective ones of the first and second channels so that when the electrodes are driven by a voltage signal ink is ejected from the first and second channels through the nozzle openings.

6. A head chip according to claim 5; further comprising a guide wall connected to the first and second substrates to define with the first and second partition walls a plurality of ink chambers each disposed in communication with a respective one of the first and second channels.

7. A head chip according to claim 6; wherein the first and second substrates are made of a transparent dielectric material.

8. A head chip according to claim 7; wherein the first and second partition walls are made of piezoelectric ceramic.

9. A head chip according to claim 8; wherein the nozzle plate is made of a dielectric material.

10. A head chip according to claim 5; wherein the nozzle plate is made of a dielectric material.

11. A head chip accord to claim 1; further comprising a pair of cover plates each connected to respective ones of the first and second partition walls.

12. A head chip according to claim 11; wherein one of the cover plates has an ink supply port for supplying ink to the first and second channels.

13. A head chip according to claim 12; further comprising a guide wall connected to the first and second substrates to define with the first and second partition walls a plurality of ink chambers each disposed in communication with the ink supply port of the cover plate and with a respective one of the first and second channels.

14. A head chip according to claim 13; wherein each of the first and second substrates has an ink communication hole disposed in communication with the ink chambers.

15. A head chip according to claim 11; wherein the cover plates are made of a transparent dielectric material.

16. A head unit comprising: a head chip as in any one of claims 1–15; and a head holder for supporting the head chip.

17. A head unit according to claim 16; further comprising an ink cartridge detachably supported by the head holder for supplying ink to the head chip.

18. A head chip comprising:

a substrate having a first main surface and a second main surface opposite the first main surface;

a plurality of first partition walls disposed on the first main surface of the substrate and spaced apart at a preselected interval to form a plurality of first channels each for receiving ink and having a pair of side walls;

a plurality of second partition walls disposed on the second main surface of the substrate and spaced apart at a preselected interval to form a plurality of second channels each for receiving ink and having a pair of side walls;

a plurality of electrodes connected to the side walls of the first and second channels and driven by a voltage signal to deform the side walls to vary the volume in the first and second channels to thereby eject ink from the first and second channels; and a pair of cover plates each connected to respective ones of the first and second partition walls.

19. A head chip according to claim 18; wherein the substrate is made of a transparent dielectric material.

20. A head chip according to claim 19; wherein the first and second partition walls are made of piezoelectric ceramic.

21. A head chip according to claim 18; further comprising a nozzle plate having a first surface connected to the substrate, a second surface disposed opposite the first surface, and a plurality of nozzle openings each extending through the first and second surfaces of the nozzle plate and disposed in communication with respectives one of the first and second channels so that when the electrodes are driven by a voltage signal ink is ejected from the first and second channels through the nozzle openings.

22. A head chip according to claim 18; further comprising a guide wall connected to the substrate to define with the first and second partition walls a plurality of ink chambers each disposed in communication with a respective one of the first and second channels.

23. A head chip according to claim 18; wherein one of the cover plates has an ink supply port for supplying ink to the first and second channels.

24. A head chip according to claim 23; further comprising a guide wall connected to the substrate to define with the first and second partition walls a plurality of ink chambers each disposed in communication with the ink supply port of the cover plate and with a respective one of the first and second channels.

25. A head chip according to claim 24; wherein the substrate has an ink communication hole disposed in communication with the ink chambers.

26. A head chip according to claim 18; wherein the cover plates are made of a transparent dielectric material.

* * * * *